US005137115A

United States Patent [19]

Arnold

[11] Patent Number: 5,137,115

[45] Date of Patent: Aug. 11, 1992

[54] SAFETY CAGE WITH IMPROVED LATCH MECHANISM

[75] Inventor: Peter S. Arnold, Alta Loma, Calif.

[73] Assignee: Metropolitan Stevedore, Wilmington, Calif.

[21] Appl. No.: 751,176

[22] Filed: Aug. 28, 1991

[51] Int. Cl.[5] ..... E04G 3/10; E04G 21/32

[52] U.S. Cl. ..... 182/142; 182/150; 182/222

[58] Field of Search ..... 182/142, 143, 150, 222, 182/113

[56] References Cited

U.S. PATENT DOCUMENTS

| | | | |
|---|---|---|---|
| 4,478,312 | 10/1984 | Kurtgis | 182/142 |
| 4,564,161 | 1/1986 | Frye | 182/150 |
| 4,676,339 | 6/1987 | Rybka | 182/142 |
| 4,705,140 | 11/1987 | Dudley | 182/142 |

*Primary Examiner*—Reinaldo P. Machado
*Attorney, Agent, or Firm*—Fulwider, Patton, Lee & Utecht

[57] ABSTRACT

A safety cage utilized in connection with a cargo container hoisting bridle crane including a safety mechanism for securing the safety cage to the cargo container bridle. A plurality of locking pins are rotatably mounted within the roof assembly of the safety cage. Connector beams adapted for receiving the locking pins are mounted on the bridle in such a manner that when the bridle is lowered onto the top of the safety cage the locking pins are positioned within the connector beams. An activation assembly is provided by means of which the locking pins can be rotated to a locked position within the connector beams thereby securely joining together the safety cage and bridle.

18 Claims, 7 Drawing Sheets

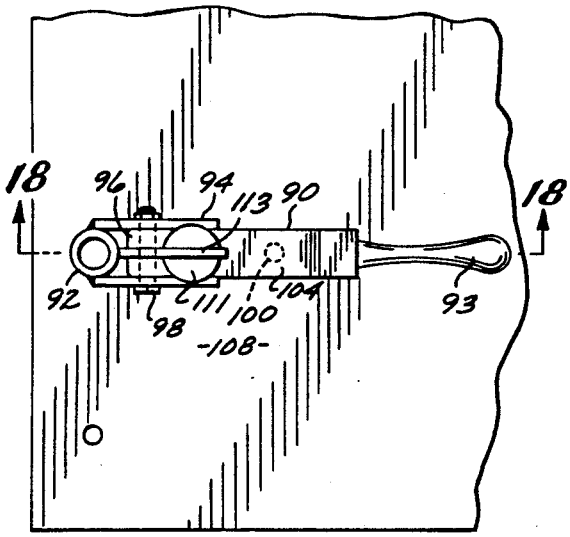
FIG.17
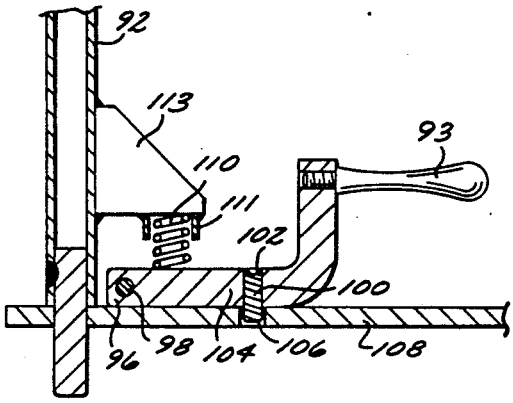
FIG.18
FIG.19
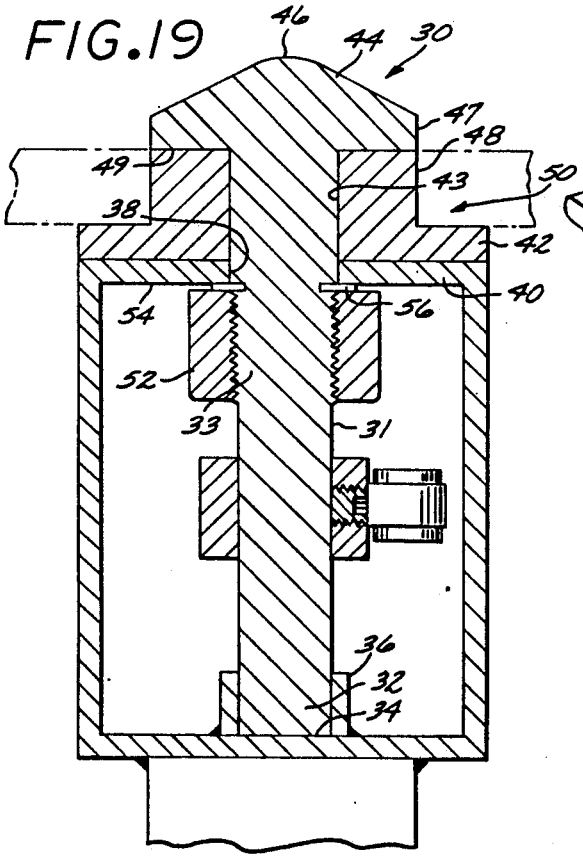
FIG.20
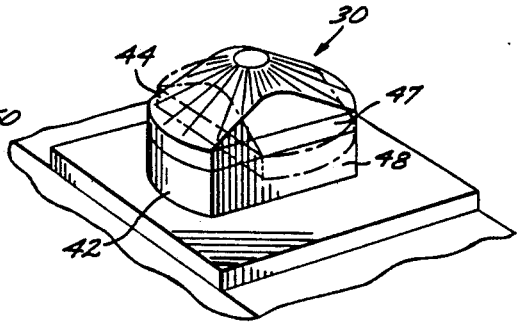
FIG.21
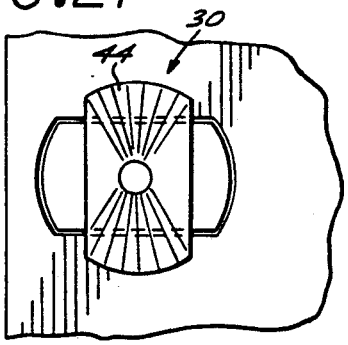

SAFETY CAGE WITH IMPROVED LATCH MECHANISM

FIELD OF INVENTION

This invention relates to the field of latching mechanisms used in connection with safety cages. More particularly, the subject invention relates to a safety latch mechanism for use in conneciton with safety cages utilized in connection with attending to locks on cargo containers.

BACKGROUND OF INVENTION

Modern cargo ships more and more frequently carry their loads in large rectangular boxes referred to as containes. These containers are normally made of steel or some other metal material and are strengthened to withstand stacking upon each other and a variety of forces imparted to the container by virtue of the vessel's motion while at sea. These containers come in a variety of sizes, however, a size of 20 L by 8 W by 8 H is considered an industry standard.

These cargo containers are moved about by cranes by means of a bridle or spreader suspended from the crane having hooks or locking pins which engage eyes formed in the upper corners of the containers. The crane raises the bridle to hoist the container aloft and move it to a desired location for stacking or loading. In storage, the containers are usually stacked one upon another and the stacks are placed side-by-side to from rows of containers. Devices known in the art as "cones" are used to join and lock the upper corners of adjacent containers and thereby prevent accidental slippage or displacement of containers. These "cones" are placed or removed by workmen who climb atop and then traverse across the tops of the stacks of containers. This prior manual method of connecting or unlocking containers created a potential safety problem for the workmen.

In order to provide a means for preventing the workmen from being exposed to injury resulting from traversing across the tops of the stacked containers, it has been known to utilize a safety cage within which the workmen are held while working on the stacked containers. Such a safety cage is disclosed in U.S. Pat. No. 4,705,140. Although safety cages such as that disclosed in U.S. Pat. 4,705,140 provide an improved work safety environment for workmen engaged in locking and unlocking the stacked containers, these types of safety cages still require the workmen to climb about the safety cage in order to engage the hooks from the container handling bridle or spreader with the engaging eyes formed in blocks in the upper corners of the cage frame. Previously a workman who was in the safety cage was required to climb upon the cage and individually fasten the hook in each corner of the container handling bridle into its respective engaging eyes in the corner blocks. During the course of this fastening operation in which the container handling bridle or spreader was placed into locking engagement with the top of the safety cage the workman was exposed to the possible hazard of slipping or otherwise falling either within or without the safety cage. The present invention eliminates this problem by providing for an improved safety cage latching mechanism which allows the workman to safely engage the safety cage to the cargo handling bridle by means of a single engagement movement which is undertaken safety within the confines of the safety cage itself.

SUMMARY OF THE INVENTION

Briefly, and in general terms, the present invention provides a safety cage which when filled with workmen is hoisted atop a centrally located stack of cargo containers, wherein the safety cage is connected to and lifted by means of a slightly modified standard existing container handling bridle and crane whereby the safety cage can be locked together with the cargo container handling bridle by means of a centrally located locking mechanism which simultaneously locks the top of the safety cage to the container handling bridle at each of the four corners of the bridle.

In the presently preferred embodiment, by way of example and not necessarily by way of limitation, workmen enter the cage while it is still on the ground. The cargo handling bridle is lowered to the top of the safety cage. As the cargo handling bridle is lowered onto the safety cage, a plurality of twist locks which extend upwardly from the top of the safety cage pass through a corresponding number of mating engagement slots formed in the bottom surface of the bridle. Once the twist locks have passed through the engagement slots and the bridle rests atop the safety cage, one of the workman within the safety cage activates the latching mechanism by means of rotating a latch mechanism handle. The rotation of the latching mechanism handle causes each of the twist locking pins to rotate 90° whereby said locking pins are extended across said engagement slots preventing the locking pins from being withdrawn from the cargo handling bridle. By means of this locking engagement mechanism, the safety cage is lockingly engaged with the cargo handling bridle by means of a single movement of one of the workmen without the necessity of any of the workmen having to climb about the safety cage to fasten the standard cargo hooks of the cargo handling bridle with the engaging eyes formed in the upper corners of the safety cage.

In addition to the cargo handling bridle being locked to the safety cage by means of the safety locking mechanism, as an additional safety precaution, the cargo hooks of the cargo handling bridle being may then be subsequently engaged with the engaging eyes formed in the corner blocks of the safety cage. The cargo crane then lifts the cargo handling bridle in the usual manner to hoist the safety cage and place it atop one of the centrally located stacks of containers. During this lifting process, the safety cage is connected to the cargo bridle by both the cargo hooks mounted in the bridle and the locking pins mounted in the safety cage thereby providing a dual locking arrangement for increased safety of the workmen. In order to be interchangeably usable with container handling bridles of differing sizes or configurations, the safety cage is provided with a dual set of simultaneously activated twist locking pins.

The subject safety cage has a rotatable roof beam with a pair of telescoping extension arms from which or in connection with which workmen may exit the safety cage and walk across the tops of the containers towards more remote corner spots, yet all the while remaining safely tethered to the boom. A trolley mechanism rolls freely along the boom track allowing for a safety cable to be played out as needed to follow the movement of the worker, thereby providing a wide range of movement across the stacked containers. When not in use, the extension arms are retracted and the boom is rotated into a compact, stowed position. The subject invention includes the new improved quick-release catches for holding the boom in both the stowed and deployed positions as well as a new improved fail safe and positive locking mechanism securing the arms in both stowed and deployed positions.

These and other objects and advantages of the subject invention will become apparent from the following more detailed description when taken in conjunction with the accompanying drawings of illustrative embodiments.

BRIEF DESCRIPTION OF DRAWINGS

FIG. 17 is a top view of the handle assembly of the activation means taken along line 17—17 of FIG. 15.

FIG. 18 is a cross-sectional side view of the handle means of the activation means taken along line 18—18 of FIG. 15.

FIG. 19 is a cross-sectional side view of the locking pin assembly of the subject invention taken along line 19—19 of FIG. 15.

FIG. 20 is a partial perspective view of the locking pin of the subject invention.

FIG. 21 is a top view of the locking pin of the subject invention.

DETAILED DESCRIPTION

Figure 1:
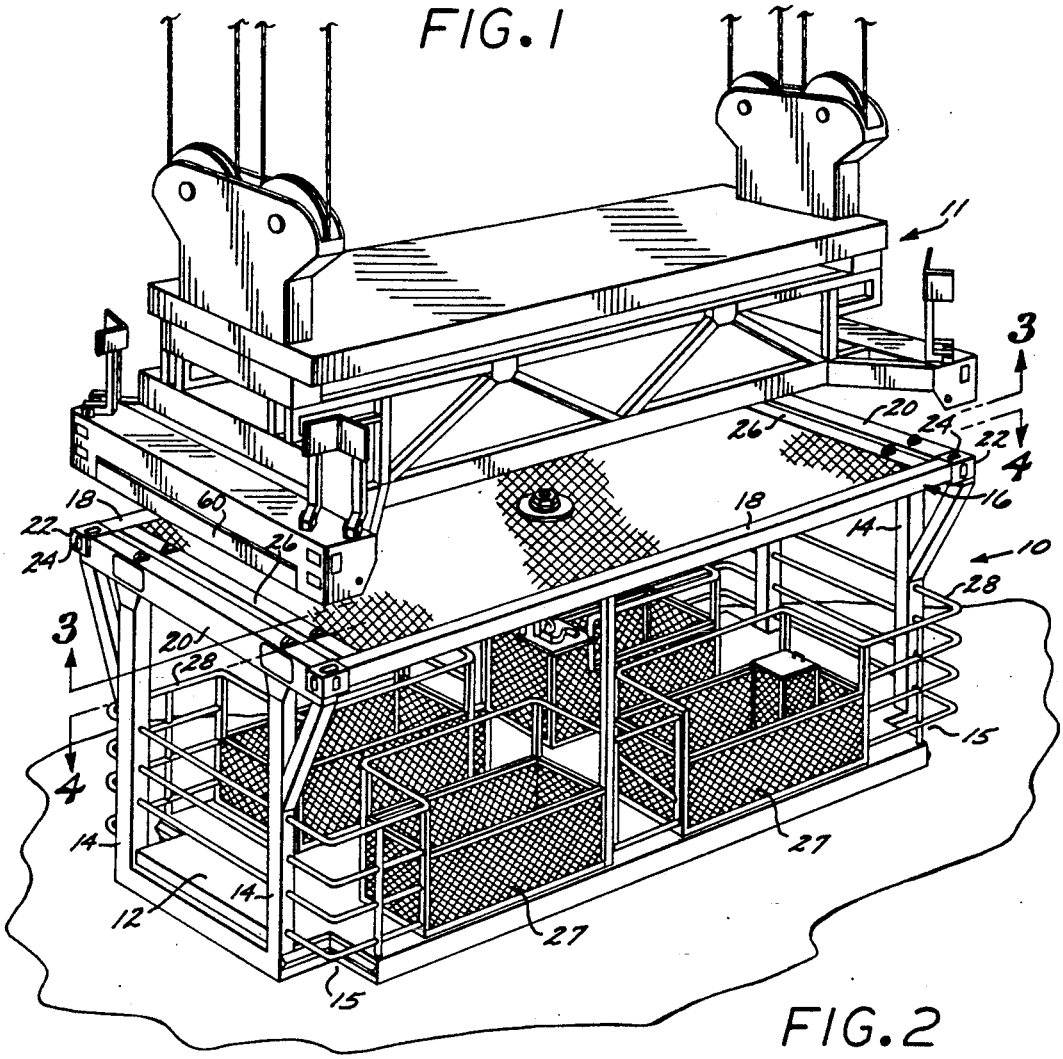
FIG. 1 is a perspective view of a safety cage and spreader mechanism embodying features of the present invention.
Figure 4:
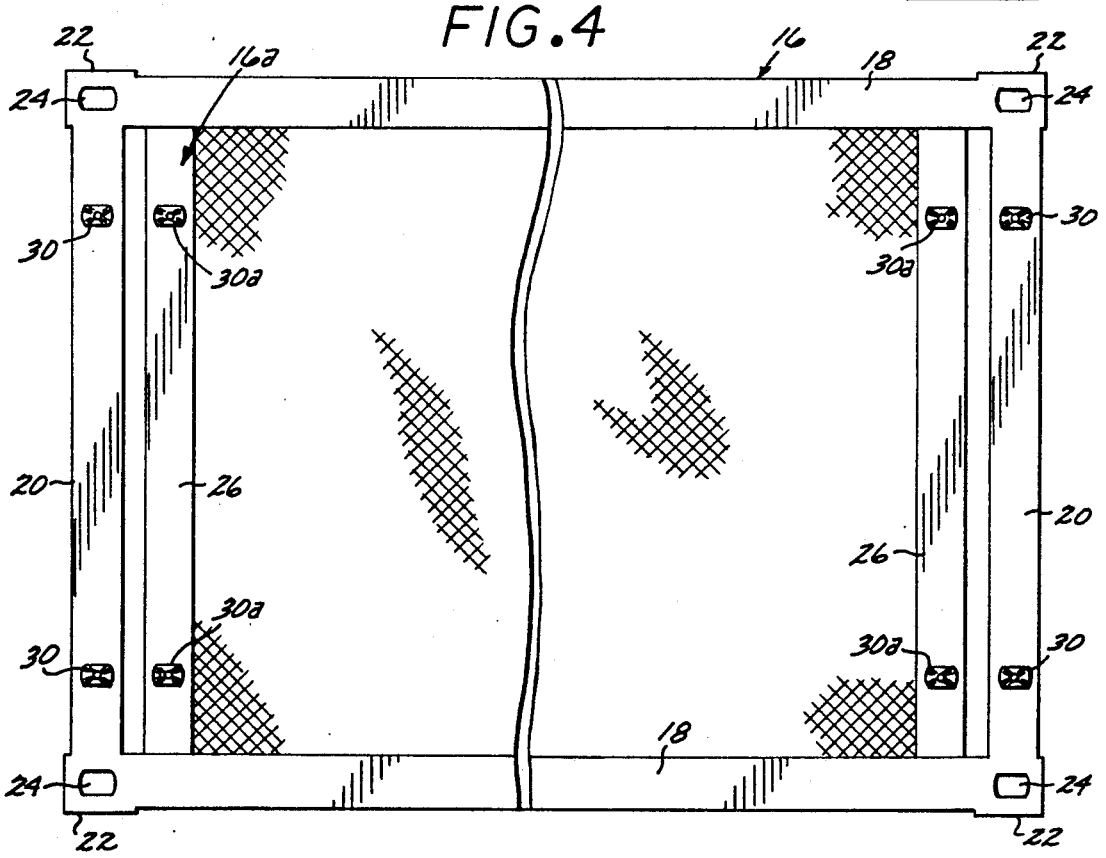
FIG. 4 is a top view of the safety pin locking assembly of the subject safety cage taken along line 4—4 of FIG. 1.

As shown in the drawings for purposes of illustration, and with particular reference to FIGS. 1 and 4, the invention is embodied in a safety cage 10 which is adapted to be connected to a standard container handling bridle 11 and subsequently hoisted atop a stack of interlockable cargo containers (not shown) to provide safe access to the locks in the upper corners of the containers).

The cage 10 is made up of a plurality of various steel members which are welded together to form a substantially rectangular framework structure. The framework usually includes a deck 12, side members 14 extending upright from the deck 12, and a roof frame 16 mounted atop the side members 14. The deck 12 is formed of sheet metal and rests upon a floor frame (not shown). Side members 14, which are located at the interior corners of cutout sections 15 of the floor section 12, extend upward from said deck and engage and support roof frame 16. As shown in FIGS. 1 and 4, roof frame 16 is comprised of a pair of side beams 18 which extend lengthwise along the long side of the safety cage 10 and a pair of shorter end beams 20 which are mounted atop side members 14 and extend across the shorter side or width of the safety cage. Cargo hook engaging corner blocks 22 are mounted within each upper corner of the roof frame 16. Each corner block 22 includes a plurality of engaging eyes 24 for engagement with the hooks on a standard cargo container handling bridle. A second pair of end beams 26 is mounted within the frame 16 wherein each of the end beams 26 is positioned a designated distance inward from end beams 20 so as to create a rectangular roof frame 16*a* having the same width as rectangular roof frame 16 but being of a shorter length than that of roof frame 16. As will be discussed in more detail below, the roof frame 16*a* allows the safety cage to be utilized in connection with cargo handling bridles having a different configuration than the standard bridle.

As with a standard safety cage, the safety cage 10 of the subject invention includes a plurality of guard rails 28 extending about the periphery of the safety cage so as to provide a safety restraining means by which the workmen are prevented from falling out of said safety cage. Additionally, a plurality of wire mesh storage bins 27 are positioned within the safety cage 10 whereby locking cones (not shown) may be stored either for their subsequent utilization in locking containers together or stored as they are removed from containers which are being unfastened. Also, as shown in FIG. 1, the safety cage 10 is provided with cut-out sections 15 in each corner of the safety cage to allow the workmen access to the upper corners of the cargo containers without having to exit the safety cage when the safety cage is set atop a container.

Although the safety cage of the subject invention is equipped with standard container hook engagement means consisting of the engaging blocks 22 and engaging eyes 24 in each of the corners of the roof frame 16 of said safety cage, it is also equipped with a synchronous locking mechanism for locking the safety cage 10 to a cargo handling bridle simply by means of rotating an activation handle which will be described in greater detail. As shown in FIGS. 1 and 4, end beams 20 and end beams 26, forming part of support roof frames 16 and 16*a*, respectively, are each equipped with a pair of rotatable locking pins 30 and 30*a*, respectively, which extends vertically upward from the upper surface of the end beam. Locking pins 30 and 30*a* have the same construction in both beams 20 and beams 26. In the preferred embodiment, said end beams 20 and 26 are formed from a rectangular tube.

The construction of the locking pin mechanism is illustrated in FIGS. 19, 20 and 21. As shown in FIG. 19, the locking pin 30 is mounted within end beam 20 or 26. The base 32 of said locking pin 30 rests upon the bottom 34 of the end beam and is rotatably positioned within a hollow cylindrical guide and support sheath 36 which is spot welded to the floor of the beam. The shaft 31 of the locking pin 30 extends upward through the body of the end beam and through aperture 38 formed in the top wall 40 of the end beam. As shown in FIG. 19, the shaft 31 of the locking pin 30 extends a predetermined distance above the top wall 40 of said beam. A step spacer 42 is also positioned atop the beam whereby the shaft 31 of the locking pin 30 extends through an aperture 43 in the spacer 42, said aperture 43 being coaxial with the aperture 38 in the top 40 of the beam. A rounded head 44 is formed at the top of the locking pin 30 having a curved upper surface 46. As also shown in FIG. 19, the guide edge 47 of the locking pin head 44 is coplanar with the exterior side wall 48 of the spacer 42. A stepped recess 50 is formed in the spacer 42, wherein the recess 50 has a depth approximately equal to or slightly greater than the thickness of the walls of the receiving member in the crane hoisting bridle. This member is shown in phantom lines in FIG. 19 and is described in detail below.

Figure 12:
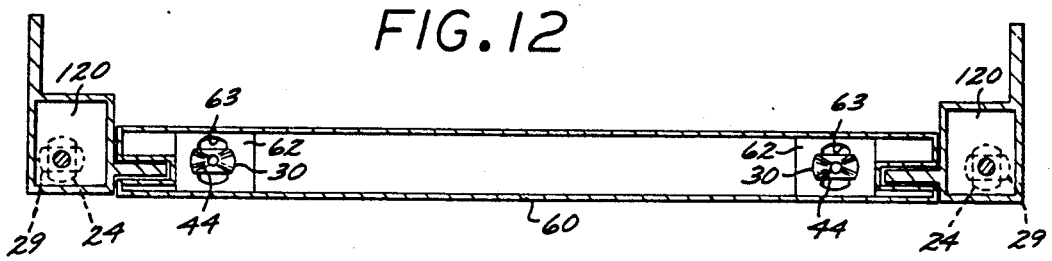
FIG. 12 is a top cross-sectional view of the subject invention in interlocking relationship along line 12—12 of FIG. 11.

The locking pin 30 is maintained in place, with respect to vertical displacement, within the end beams 20 and 26 by means of a locking nut 52 which is threaded onto an intermediate threaded section 33 provided on the shaft 31 of the locking pin 30. The locking nut 52 and threaded section 33 of the sfaft 31 are positioned closely adjacent to the bottom surface 54 of the tube member. A spacer or washer 56 is provided between the upper surface of the locking nut and the bottom surface of the channel. FIG. 20 shows the locking pin 30 in the closed or non-locking position wherein the locking pin head 44 is aligned with the step spacer 42. The locking pin 30 is illustrated in the locking or closed position by means of phantom lines in FIG. 20. FIG. 21 shows a top view of the locking pin 30 in the closed or locking position. In this position, the locking pin head 44 is rotated 90° from its closed position. In this operation, the bridle 11 is lowered onto the top of the safety cage 10 in such a manner so that the locking pins 30 extending upward from the top surface of beams 20, 26 pass through apertures in the bottom surfaces of the hoisting bridle 11. Locking pins 30 and the bridle apertures have an essentially rectangular configuration as shown in FIG. 12 and 21. Locking pins 30 are of a slightly smaller size than the apertures allowing the pins to be inserted through the apertures. After the bridle has come to rest atop the safety cage, the locking pins are rotated 90° to the positions shown in FIGS. 20 and 21, wherein the longer axis or side of the locking pin 30 is aligned with the shorter axis or side of the aperture, at which time the bottom surfaces 49 of the locking pin head 44 will engage the interior surface of the bridle members preventing the locking pin 30 from being withdrawn outward through the apertures. In this position, when bridle is lifted by the crane, the safety cage will also be lifted. This locking engagement between locking pins 30 and the bridle is shown in FIGS. 13 and 14.

Figure 2:
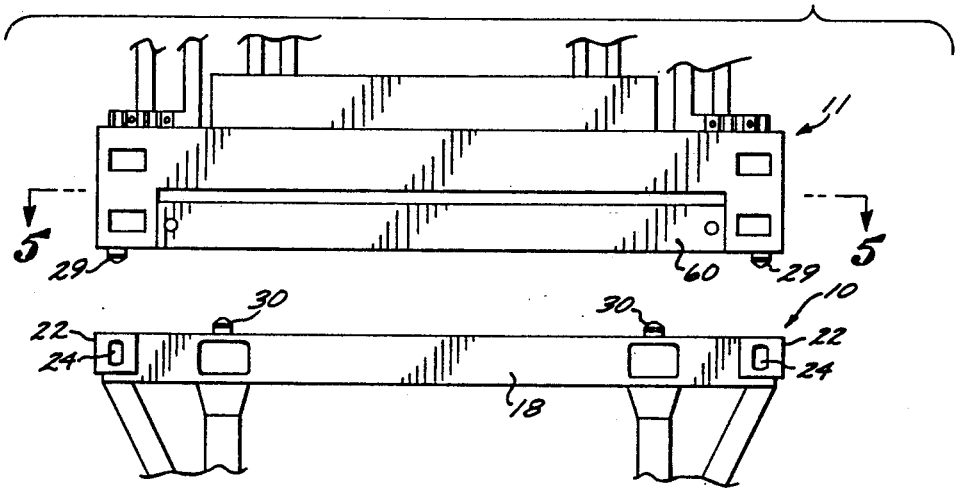
FIG. 2 is a partial end view of the subject safety cage and spreader mechanism of the invention.
Figure 13:
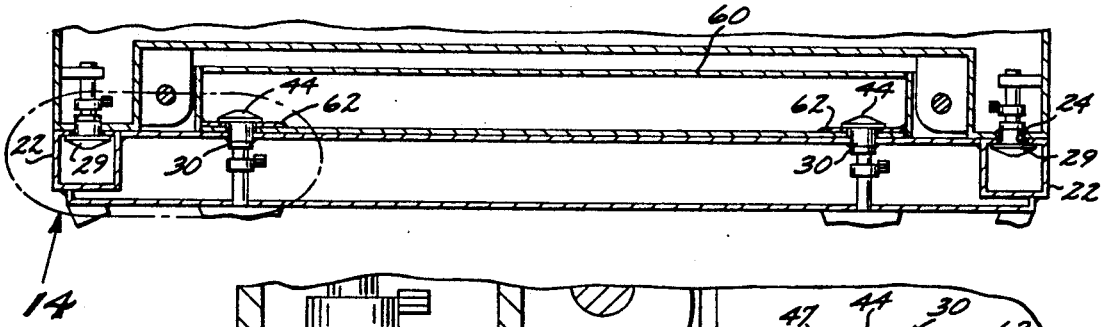
FIG. 13 is a cross-sectional side view of the subject invention in the interlocking engagement position.
Figure 14:
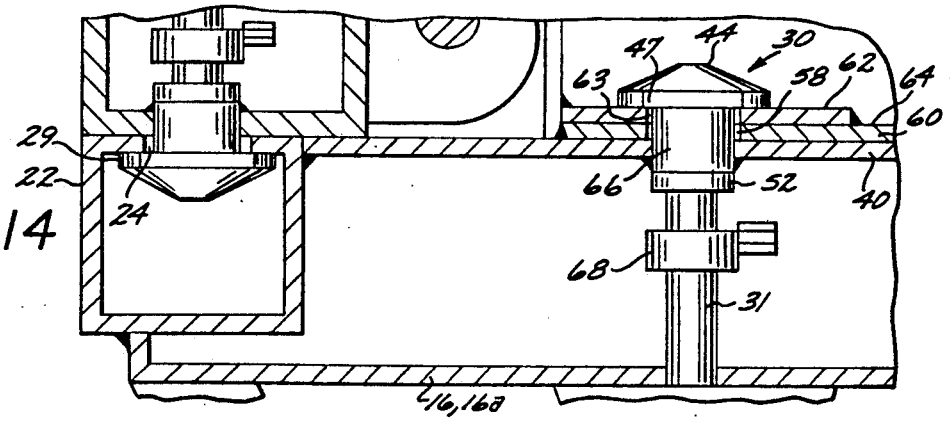
FIG. 14 is a detailed cross-sectional side view of the subject invention taken from area 14 of FIG. 13.

The original or primary coupling or connection of the bridle 11 to the safety cage 10 is accomplished by means of locking pins 29 mounted in the underside of the bridle as shown in FIG. 2 and in detail in FIG. 13 and 14. In a standard rectangular shaped bridle, a locking pin 29 is provided in each corner. The locking pins 29 are connected by a remote activation assembly (not shown). When the bridle 11 is lowered onto the safety cage 10 bridle locking pins 29 are inserted into engaging eyes 24 located in the top corner engaging blocks 22 in the upper corners of safety cage 10. Both the locking pins 29 and engaging eyes 24 are essentially rectangular in shape, with locking pins 29 being slightly smaller than engaging eyes 24. Locking pins 31 are then rotated 90° by means of the remote activation assembly such that pin 29 is locked or retained within corner block 22. Now when the bridle 11 is raised safety cage 10 will be raised at the same time.

As shown in FIG. 13 and in enlarged detail in FIG. 14, when the hoisting bridle 11 is lowered onto the top of safety cage 10 and rests upon safety cage roof 16 or 16*a*, locking pins 30 pass through apertures 58 located in the bottom of connector beam 60 fastened to the end of the bridle 11. In a preferred embodiment connector beam 60 is reinforced in the area of apertures 58 by means of spot welding or otherwise fastening reinforcing plate 62 to the upper surface 64 of the bottom wall 66 of connector beam 60. Aperture 63 is provided in plate 62 and is co-axial with aperture 58 in bottom well 66 of beam 60. Locking pin 30 passes through apertures 58 and 63 and is then rotated 90° such that the bottom surface 47 of locking pin head 44 extends over and engages the upper surface 63 of reinforcing plate 62. This 90° rotation of locking pin head 44 is shown in FIG. 12.

In the embodiment shown in FIGS. 13 and 14 a cylindrical sleeve 66 is inserted through and extends above aperture 38 in top wall 40 of beam 16, 16*a*. The cylindrical sleeve 66 is of a predetermined length such that when the bridle 11 is lowered onto safety cage 10, sleeve 66 passes through apertures 58 in connector beam 60 and 63 in plate 62 and the top surface 67 is coplanar with the upper surface 63 of reinforcing plate 62. The shaft 31 of locking pin 30 is inserted through cylindrical sleeve 66 and rests on the bottom of beam 20, 26. Nut 52 is threaded onto intermediate threaded section 33 to maintain the locking pin 30 in place with respect to vertical displacement. The locking pin 30 is rotated between locking and unlocking position by means of collar 68 as will be described below.

Figure 15:
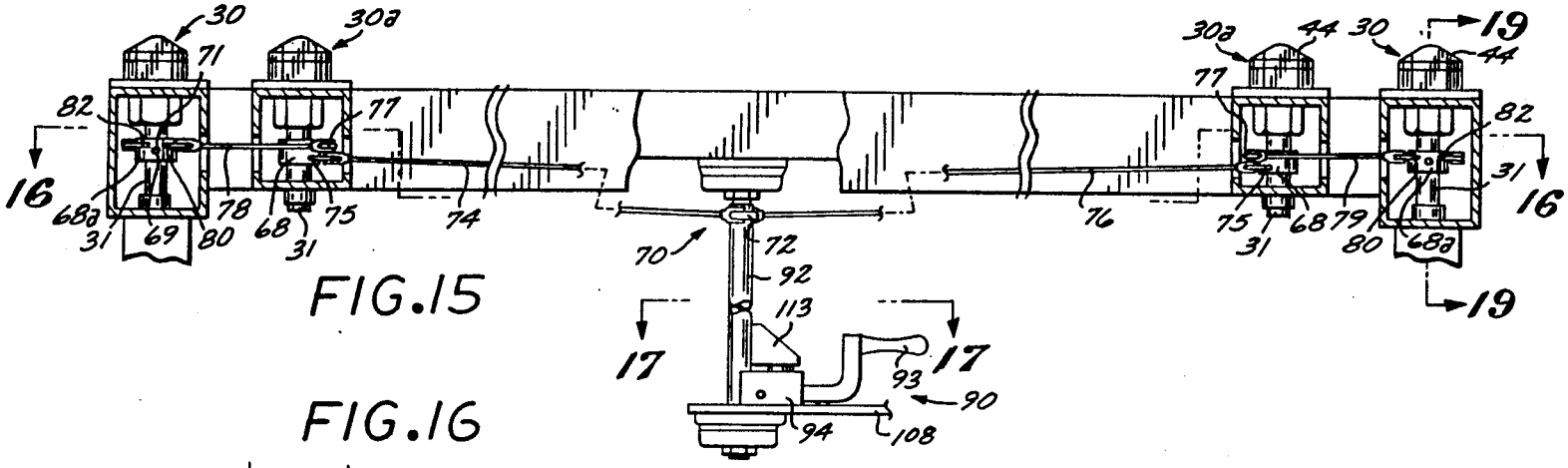
FIG. 15 is a partial cross-sectional side view of the automatic locking pin activation of the subject invention.
Figure 16:
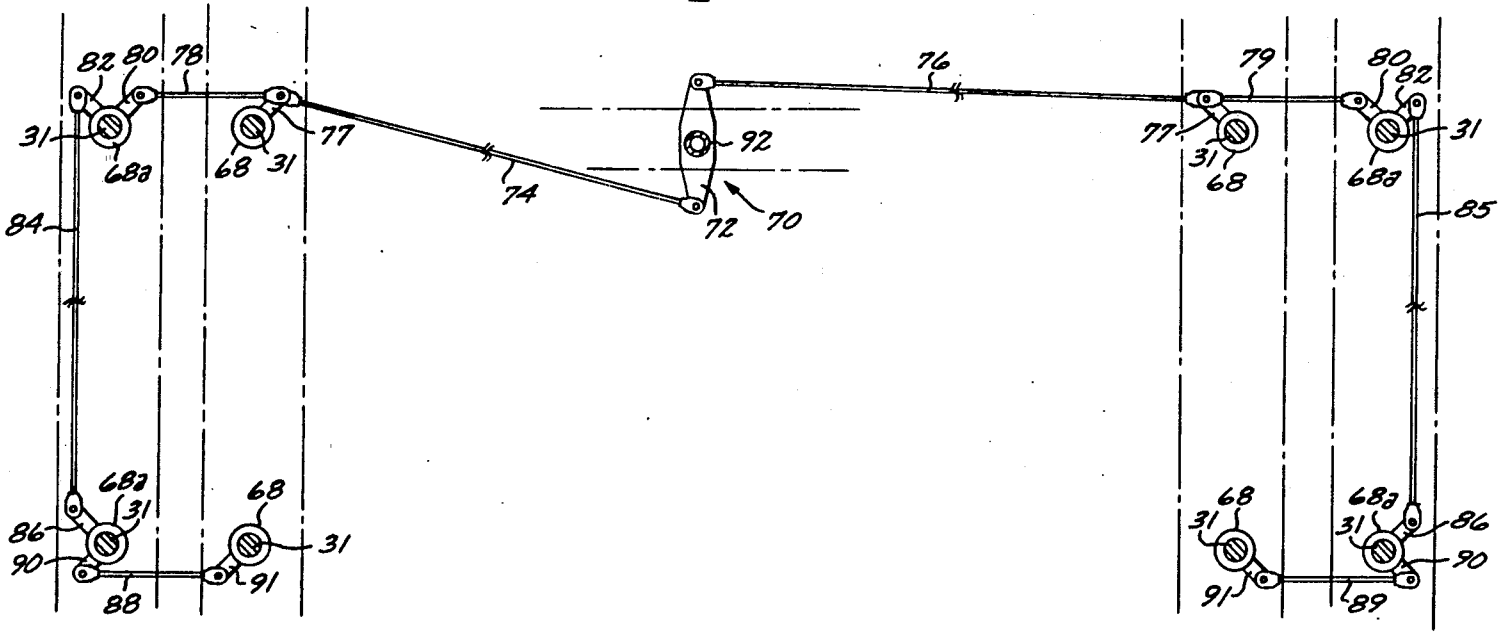
FIG. 16 is a top view of the locking pin activation assembly taken along line 16—16 of FIG. 15.

The locking mechanism assembly for operating the locking pins 30 is illustrated in FIGS. 15–16. As shown, the locking mechanism consists of a manually operated linkage assembly 70. The locking pins are operated by means of this manually operated linkage assembly 70. As shown in FIG. 15, lever 72 is rotatably mounted at a center point of the safety cage 10. Drive rods 74, 76 pivotally connect each end of the lever 72 with the first locking pin 30*a*. the distal end of each link rod 74, 76 is pivotally connected to arm 75 extending from collar 68 non-rotatably fastened about the shaft 31 of the locking pin 30*a*. Each of said first locking pins 30*a* is in turn connected to first locking pins 30 by means of pivotally mounted second rod member 78, 79. The proximate end of rod members 78, 79 being connected to arm 77 extending from collar 68 and the distal end of the second rod member 78, 79 is pivotally connected to a first crank arm 80 extending from a non-rotatably mounted collar 68*a* which is fastened about the locking pin shaft 31. A second crank arm 82 extends outward from the collar 68 at a 90° angle to said first crank arm 80. This first locking pin 30 is connected to second locking pin 30 by means of a third rod arm 84, 85, one end of which is pivotally connected to the second crank arm 82, the distal end of said rod arm 84, 85 being pivotally connected to a first arm 86 on non-rotating collar 68*a* non-rotatably fastened to the shaft 31 of locking pin 30. This locking collar 68 is connected to second locking pin 30*a* by means of a fourth rod arm 88, 89 one end of which is pivotally connected to crank arm 90 extending from the locking collar 68, the other end being connected to crank arm 91 connected to collar 68.

Thus, as viewing FIG. 16, when lever 72 crank is rotated in a clockwise direction, first rod 74, 76 imparts rotation to first locking pin 30*a* which in turn translates simultaneous rotation of second locking pin 30 through movement of second rod 78, 79 which movement is translated through the locking collars 68 to a translational rotational movement of locking pins 30 and 30*a*, respectively. The interconnection of the various linkage rods 74, 76, 78, 79, 84, 85, 88, and 89 with the crank collars 68 and 68*a* is shown in more detail in FIG. 15. In order to operate the linkage mechanism assembly 70, handle 90 is rotated. Said handle is non-rotatably connected to crank shaft 92, the distal end of which is rigidly connected to the lever 72. Thus, rotation of handle 90 results in the operation of the linkage assembly which in turn results in the locking pins 30 and 30*a* being rotated either from locked to an unlocked position, or from an unlocked to locked position. As shown in FIG. 19, each of the locking collars 68 is non-rotatably mounted about the shaft 31 of the locking pin 30 and held in place by means of a standard set screw 69 which is threaded through a mating threaded aperture 71 in the wall of the collar 68.

Although the preferred embodiment illustrated and described herein depicts a safety cage 10 having two roof support assemblies 16 and 16*a*, incorporating corresponding sets of locking pins 30 and 30*a* for use in connection with cargo bridles 11 of differing configurations, it is to be understood that alternate embodiments incorporating a single set of locking pins 30 or 30*a* could be utilized. In these embodiments, the second set of locking pins 30 or 30*a* and connecting rods 78, 79, 88 and 89 would be eliminated.

The construction and operation of the handle mechanism will now be discussed in connection with FIG. 18. As shown in FIG. 18, the handle 90 is positioned within a housing member 94, said housing member 94 being spot welded or otherwise permanently and non-rotatably affixed to the crank shaft 92 as shown in FIG. 17. One end 96 of handle 90 is pivotally mounted within the housing member 94 by means of pin 98. By virtue of this construction, the handle 90 may be pivoted in a vertical direction and raised upward from an at-rest position. In order to prevent the unintentional rotation of the handle 90 which could inadvertently unlock the safety cage from the crane bridle 11, a locking pin 100 is press fit or otherwise non-movably inserted through an aperture 102 in the body 104 of the handle 90 such that a portion of the pin 100 extends beneath the bottom surface of the handle as shown in FIG. 18. In the locked position, this pin 100 rests within an aperture 106 in the handle support plate 108. In this position the handle 90 cannot be rotated in either direction. In order to assist in retaining the handle in the locked position, a biasing means, such as a coil spring 110, as shown in FIG. 18, is provided which exerts a constant downward pressure on the handle 90, thereby assisting in maintaining the locking pin 100 within the locking aperture 106. Coil spring 110 is secured and maintained in place by guide sleeve 111 which is spot welded or otherwise securely fastened to the underside of support bracket 113 connected to shaft 92. When it is desired to activate the locking mechanism, the user grabs the handle 90 by handle grip means 93 and lifts upward on the handle against the spring force, thereby removing the locking pin 100 from the locking pin aperture 106. At this point the handle may then be rotated in the desired direction which in turn imparts rotational movement to the crank shaft 92 resulting in the linkage assembly either locking or unlocking the locking pins 30.

The locking pin assembly mechanism is utilized in connection with the bridle assembly as shown in FIGS. 1, 11, 13 and 14. The traditional cargo handling bridle 11 or spreader is comprised of an essentially rectangular frame, having a size approximately equal to that of the standard cargo container. The frame is traditionally composed of a rigid structure such as hollow rectangular tubular steel and may be provided with cross members so as to provide rigidity to the structure. When utilized in connection with the subject safety cage improved latching mechanism, the bridle 11 is equipped with connector beams 60 which are mounted on the bridle 11 adjacent the bridle end beams 120. The construction of the connector beams 60 is shown in FIGS. 5–10. The connector beams 60 are essentially hollow rectangular tubular steel having engagement apertures 58 formed in the bottom face of the beam. When the bridle 11 is lowered onto the top of the safety cage 10, the vertically projecting locking pins 30 pass through the engagement apertures 58 in the connector beams 60 and enters the interior of said connector beams. When the activation handle 90 is rotated the activation linkage assembly 70 in turn rotates the locking pins 30 from their closed or non-engagement position shown in FIG. 20 to the locked or engagement position shown in FIG. 21. Once the locking pins 30 have been rotated to this position, they cannot be withdrawn outward from the connector beams 60 through the narrower engagement apertures 58. In this position the safety cage 10 is effectively locked or fastened to the bridle 10 such that upon the crane hoisting the bridle 11, the safety cage will be lifted along with the bridle, wherein it may then be set atop a stack of containers.

Figure 3:
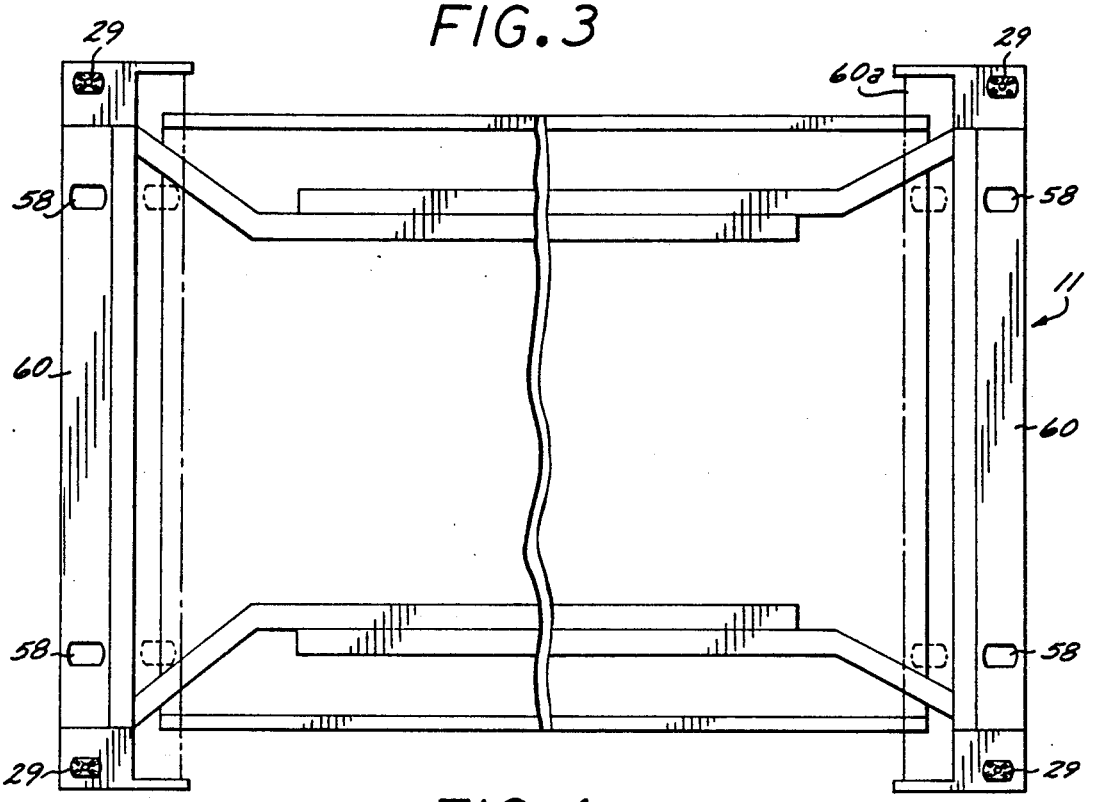
FIG. 3 is a partial bottom view of the spreader mechanism taken along line 3—3 of FIG. 1.
Figure 5:
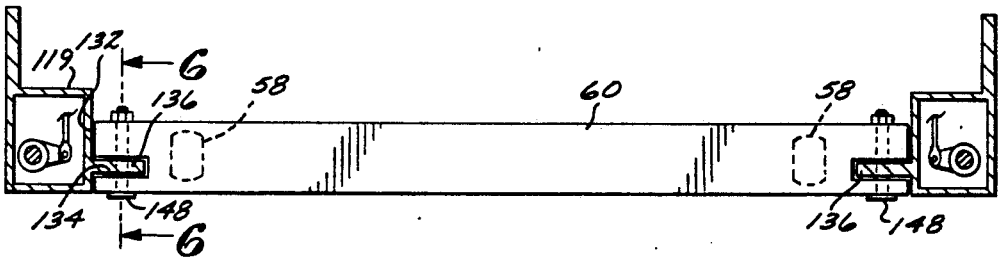
FIG. 5 is a partial cross-sectional top view of the spreader beam taken along line 5—5 of FIG. 2.
Figure 6:
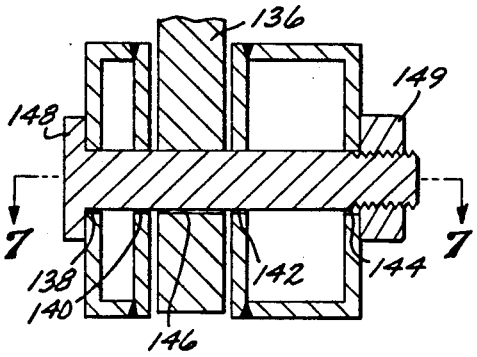
FIG. 6 is a cross-sectional side view of the spreader beam connector taken along line 6—6 of FIG. 5.
Figure 7:
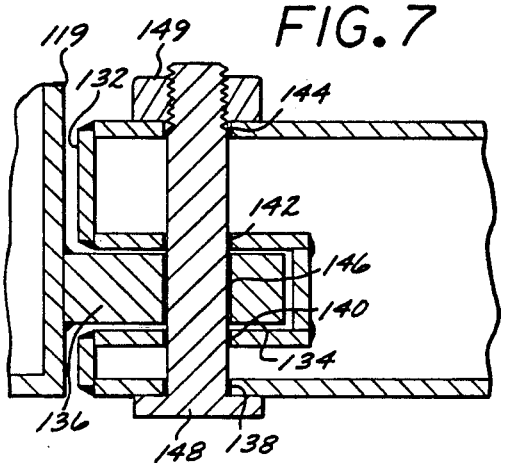
FIG. 7 is a cross-sectional view of an alternate embodiment of the spreader beam connector of the subject invention.
Figure 8:
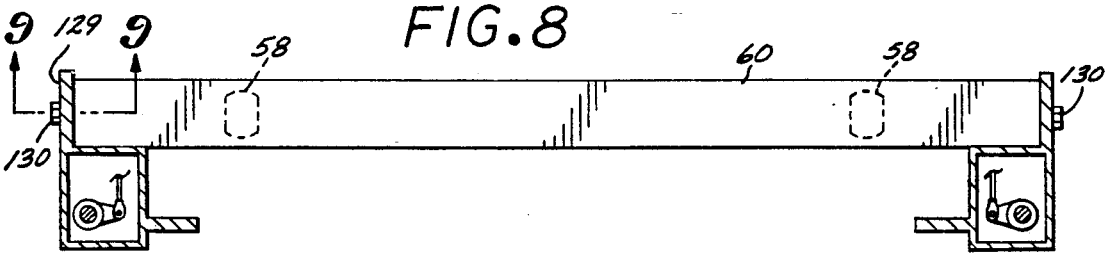
FIG. 8 is a top view of an alternate embodiment of the spreader beam of the subject invention.
Figure 9:
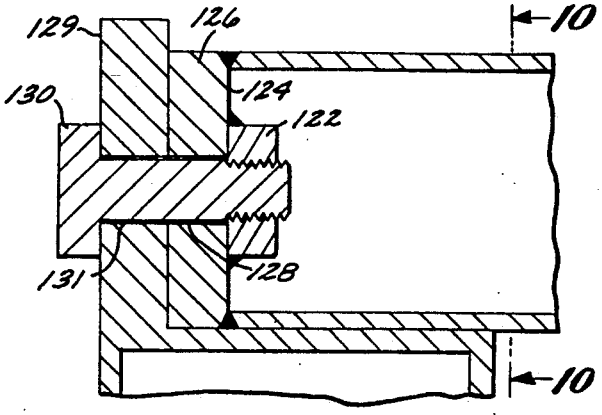
FIG. 9 is a cross-sectional view of the spreader beam connector of the subject invention taken along line 9—9 of FIG. 8.
Figure 10:
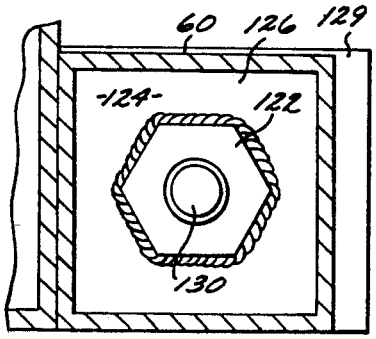
FIG. 10 is a cross-sectional side view of the spreader beam connector in the interlocking relationship taken along line 10—10 of FIG. 9.

Depending upon the configuration for the particular cargo handling bridle being utilized, the adapter beams may be connected to the bridle by a variety of means, two embodiments of which are shown in FIGS. 5 and 8. In FIG. 8 and 9, the fastening means shown is simply that of a nut 122 and bolt 130 assembly wherein a nut 122 is spot welded on the interior wall 124 of the end plate 126 of the connector beam 60 coaxially aligned with an aperture 128 in the end plate 126 which is coaxial with aperture 131 in bridle side beam 129. The connector beam 60 fits between the two side beams 129 of the bridle 11 and a bolt 130 is passed through apertures 131 and 128 and threaded into the nut 122. This is shown in phantom lines FIG. 3 as connector bean 60*a*.

An alternate embodiment of the fastening means for fastening the connector beam 60 means to the bridle 11 is shown in FIG. 5. In this embodiment, the end plate 132 of beam 60 has formed within it a stepped recess 134 which slides over flange 136 extending inward from the bridle side beam 119. Bolt holes or apertures 138, 140, 142 and 144 are coaxially formed through the walls of the connector beam and a bolt aperture 146 is formed in flange 136 of side beam whereby when the connector beam 60 is placed onto the bridle, bolt holes 138, 140, 142, 144 and 146 are all coaxially aligned and by the insertion of a bolt 148 through said apertures and tightening of nut 149, the connector beam 60 is locked or rigidly fastened to the side beam. In both embodiments, however, the connector beam plate of the tubular beam is reinforced about the engagement apertures 58 as shown. The reinforcement may simply consist of an additional piece of steel welded to the interior floor of the channel or other known reinforcing means.

As discussed earlier, the safety cage of the present invention also includes a rotatable boom 150 which the workmen may safely traverse across rows of stacked containers and remain fastened to the safety cage. The boom 150 is suspended from the roof frame 16 by means of a rotation mount 152 located substantially in the middle of a center beam 154 in the roof frame. The rotation mount 152 allows the boom assembly 150 to be rotated between a stowed position in which position the boom assembly is oriented parallel to the length or long dimension of the safety cage 10 and a deployed position in which the boom assembly 150 is rotated to an orientation parallel to the width or shorter dimension of the safety cage 10.

Figure 11:
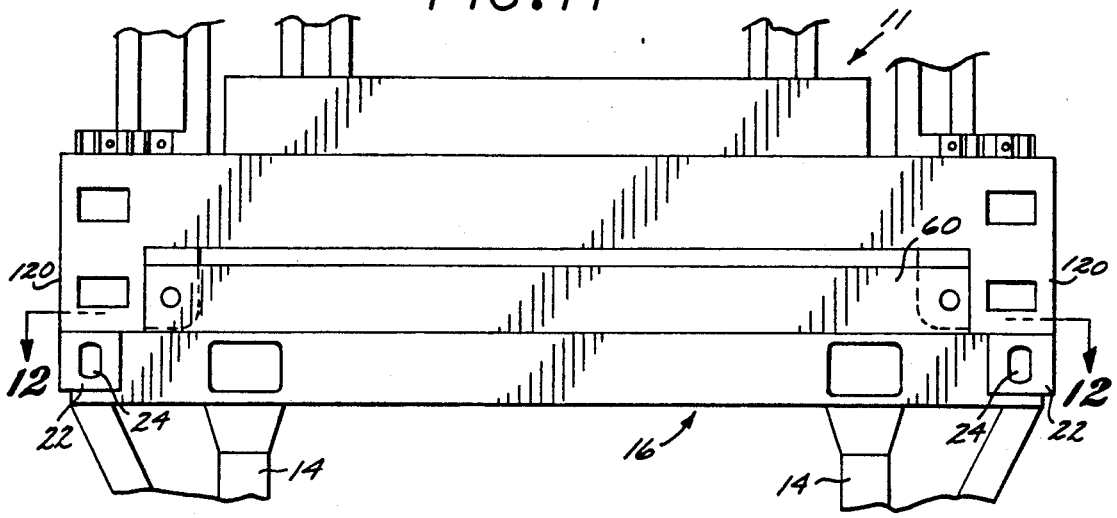
FIG. 11 is a side view of the subject invention in the interlcoking, engagement relationship.
Figure 22:
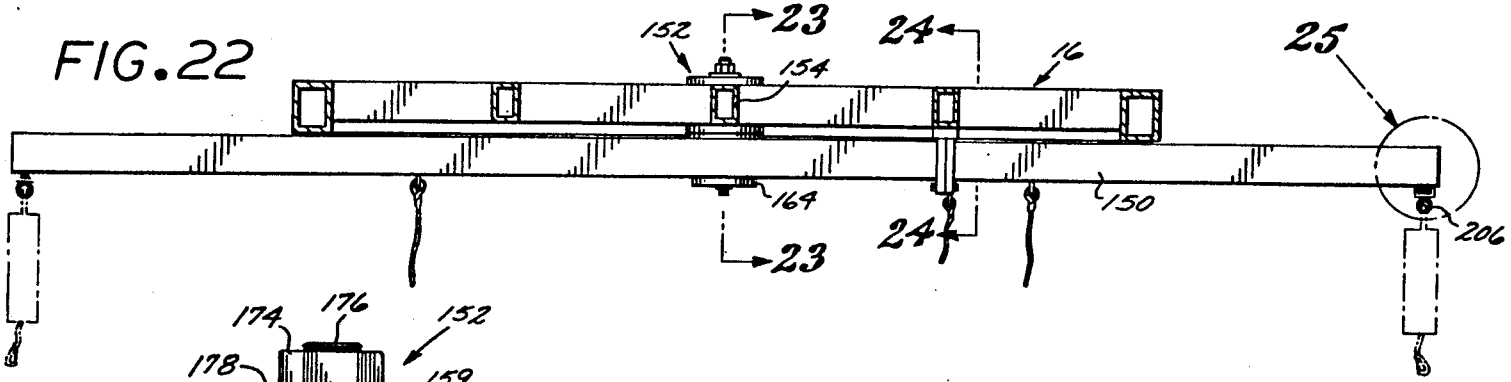
FIG. 22 is a side view of the extended boom of the subject invention with the arms in the extended position.
Figure 23:
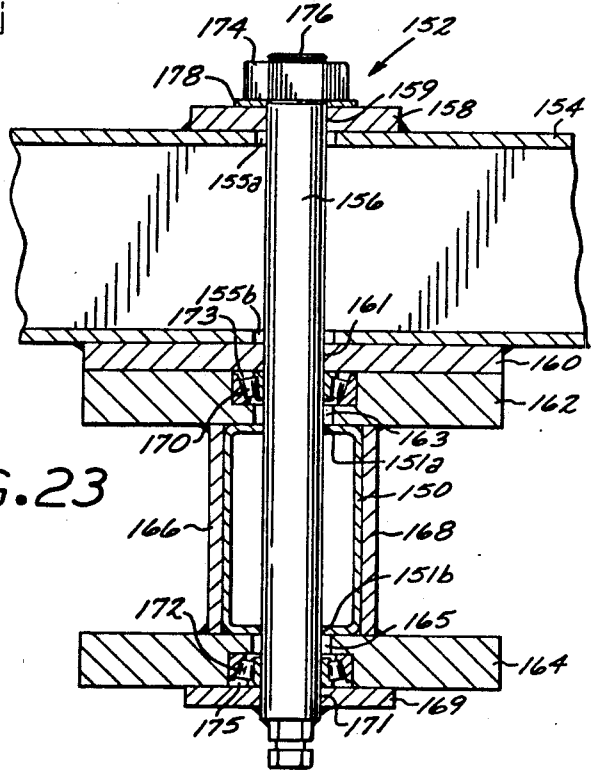
FIG. 23 is a cross-sectional view of the center pivot means of the extendable boom assembly taken along line 23—23 of FIG. 22.
Figure 24:
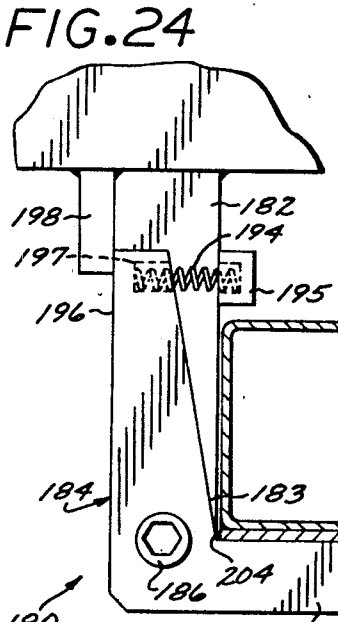
FIG. 24 is a side view of the latching hook for retaining the extendable boom in a locked position taken along line 24—24 of FIG. 22.

Referring to FIGS. 22 and 23, the rotation mount 152 includes a spindle 156. The spindle 156 is mounted through apertures 155*a, b* in the center beam 154 of the roof frame 16 and extends through apertures 151*a, b* in boom 150 as shown in FIG. 23. In a preferred embodiment a first support plate 158, including aperture 159, is spot welded to the upper surface of center beam 154 and a second support plate 160, including aperture 161, is spot welded to the underside or bottom surface of beam 154. Similarly, a support or rotation plate 162, including aperture 163, is spot welded to the upper surface of rotating boom 150 and a corresponding support or rotation plate 164, including aperture 165, is spot welded to the underside or bottom surface of boom 150. Additionally, lateral support plates 166 and 168 are spot welded to the side walls of the rotating boom 150 in the vicinity of the rotating or support plates 162 and 164. A final support plate 169, including aperture 171, is spot welded to the underside or bottom surface of rotation plate 164. Plates 158, 160, 162, 164, and 169 are positioned so that apertures 159, 161, 163, 165 and 171 are co-axial with apertures, 155*a, b* and 151*a,b* in beam 154 and 150, respectively. Upper bearing assembly 170 is provided within recess 173 in upper rotation plate 162 and a corresponding lower bearing assembly 172 is provided with recess 175 in lower plate 164 as illustrated in FIG. 11. This provides for free rotation of the boom 150 about rotation mount 152. As further illustrated in FIG. 11, the spindle 156 is held in place within center mount 152 by virtue of nut 174, threaded atop the upper exterior end 176 of the spindle 156. A washer 178 is also provided to ensure in the maintenance of the spindle in the specified position.

In order to prevent the premature or undesired rotation of the boom 150, the boom assembly is provided with a latch mechanism 180 which maintains the boom in the unused or stowed position until such time as the latch is released. In a preferred embodiment, the boom latch mechanism 180 is shown in FIG. 12. A vertical support bracket 182 is spot welded to the underside of one of the intermediate cross-beams of the roof assembly 16. An L-shaped bracket 184 is pivotally connected to the lower end 183 of the support bracket 182 by means of a standard nut and bolt assembly 186. A recessed section 188 is formed in the upper surface of the horizontal leg 190 of the bracket 184 having a sufficient width to accommodate the boom 150. Shoulder or stop 192, is formed at the exterior end of the recess, and acts to prevent rotational movement of the boom when the L-shaped bracket is in the locked position. In normal operation a biasing means, such as a coil spring 194, is provided. One end of coil spring 154 is retained within spring mount 195 with the opposite end being positioned within recess 197 in upper leg 196 of L-shaped bracket 184. In normal operation, the coil spring 194 exerts a lateral force against the upper leg 196 of the L-shaped bracket 184 so as to maintain L-shaped bracket 184 oriented in the correct vertical and horizontal position. A stop plate 198 is provided to prevent the spring 194 from causing vertical leg 196 to rotate beyond the vertical upright position. In order to release the boom for deployment, the L-shaped bracket 184 is provided with a eyelet or hook 200 spot welded to the bottom surface of the horizontal leg 190. A rope 202 or other pull device is inserted through the hook or eyelet 200 and the user simply exerts a downward pull or tug on the rope which results in the L-shaped bracket pivoting about the nut and bolt assembly thereby freeing the boom from recess 188 allowing it to be pivoted sideways. Upon release of the rope, the spring means 194 causes the L-shaped bracket to return to its normal position. When it is desired to return the boom 150 to the stowed or locked position, it is simply swung around to a point where the lower front corner of the boom 204 engages a sloped chamber surface 206 formed on the front upper face of the horizontal leg of L-shaped bracket. Continued movement of the boom 150 towards the locked position results in the downward pivoting of the L-shaped bracket 184 until such time as the boom is swung into its fully locked position at which time the boom is again at rest within recess 188 and the spring 194 is able to exert a closing force on the bracket 184 so as to reengage the boom in a locked position.

Figure 25:
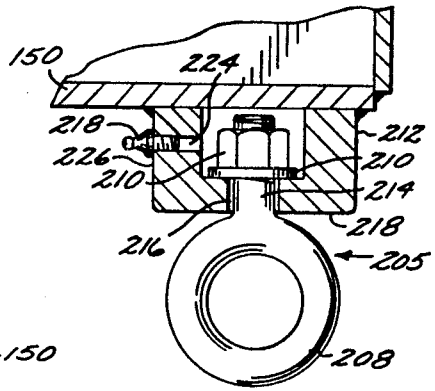
FIG. 25 is detailed cross-sectional view of the trolley hook shown in area 25 of FIG. 22.

Finally, the boom is equipped with a tether hook 205 formed at each end. As shown in FIG. 25 the tether hook is comprised of a circular eyelet 208 which is threadably connected to a nut 210 located within a U-shaped bracket 212 spot welded to the under surface of the boom. A support leg 214 extends outward from eyelet 208, the end of which is threaded. The support leg 208 is inserted through aperture 216 in the lower leg 218 of U-shaped bracket 212 and is inserted through a support washer 220 and threaded into nut 210. This prevents removal of the eyelet and provides a secure support system for the tether device for use by the workmen exiting be safety cage. A lubricating hole 224 is provided in the side wall of the upper vertical leg 226 of the U-shaped bracket, said lubricating hole being closed by means of stop 228.

In the preferred embodiment the boom 150 is comprised of telescoping sections which allow the boom to be lengthened when deployed.

Having thus described my invention, others skilled in the art will recognize variations or alternate embodiments of the invention which do not depart from the teachings herein and are considered to be part of the invention. This subject invention is not to be limited to the embodiments disclosed herein, but is to be accorded the full breadth and scope of the claims appended hereto.

What is claimed:

1. A safety cage adapted to be hoisted atop a plurality of cargo containers by means of a cargo bridle, having a safety latching mechanism comprising:

an essentially rectangular protective frame, including a roof support assembly;

at least two pairs of rotatable locking pins mounted within said roof support assembly, said locking pins extending above the top surface of said roof support assembly; and a locking pin rotation assembly mounted within said protective frame wherein operation of said locking pin rotation assembly rotates said locking pins from a locked to unlocked position and from an unlocked to locked position.

2. The safety cage of claim 1 wherein said at least two pairs of rotatable locking pins are positioned at opposite ends of the roof support assembly and further wherein said locking pin rotation assembly includes a plurality of connecting rods connecting each of the locking pins to a centrally positioned handle assembly whereby operation of the handle assembly simultaneously operates each of the locking pins.

3. The safety cage of claim 2 wherein the locking pin rotation assembly further includes a lever arm rotatably mounted about its center point, wherein a first connecting rod connects one end of said lever arm to one of the locking pins at one end of the rod support assembly, and a second connecting rod connects said locking pin to the other locking pin located at said same end of the roof support assembly, and a third connecting arm connects the distal end of said lever arm with one of said locking pins at the opposite end of the roof support assembly and a fourth connecting rod connects said locking pin to the other locking pin at said opposite end of the root roof support assembly.

4. The safety cage of claim 3 further comprising a locking means for preventing the accidental operation of the locking pin rotation assembly.

5. A safety cage and cargo bridle assembly for providing safety in the transportation of the safety cage comprising:

a cargo container bridle;

a protective frame having a roof assembly having the same configuration as the cargo container bridle;

a first pair of rotatable locking pins positioned within one end of said roof assembly and a second pair of rotatable locking pins positioned within the opposite end of said roof assembly;

a locking pin activation assembly mounted within said protective frame; said activation assembly being connected to said first and second pairs of rotatable locking pins, said activation assembly rotating said locking pins from locked to unlocked positions and from unlocked to locked positions;

first and second connector members fastened to said cargo bridle, said connector members being adapted to receive said first and second pairs of locking pins wherein when the protective frame and cargo bridle are securely joined together when the locking pins are rotated to the locked position.

6. The safety cage and cargo bridle assembly of claim 5 wherein said first pair of locking pins are connected by means of a first connecting rod and said second pair of locking pins are connected by a second connecting rod.

7. The safety cage and cargo bridle of claim 6 wherein said activation assembly includes a rotatable level member having opposed arms, a first activation rod connecting one of said lever member arms with said first pair of locking pins and a second activation rod connecting the remaining lever member arm with said second pair of locking pins; and handle means for rotating said lever member.

8. The safety cage and cargo bridle of claim 7 further comprising locking means for preventing the accidental operation of the handle means.

9. The safety cage and cargo bridle of claim 5 further comprising locking pin means in said cargo container bridle of engaging said protective frame and locking pin receiving means in said protective frame for receiving said locking pin means.

10. A safety cage adapted to be hoisted atop a plurality of cargo containers by means of a cargo bridle, having a safety latching mechanism comprising:

an essentially rectangular protective frame, including a roof support assembly said roof support assembly including a first pair of end members and a second pair of end members located within said first pair of end members;

a pair of rotatable locking pins mounted within each of said end members, said locking pins extending above the top surface of said end members; and a locking pin rotation assembly mounted within said protective frame wherein operation of said locking pin rotation assembly rotates said locking pins from a locking to unlocked position and from an unlocked to locked position.

11. The safety cage of claim 10 wherein said locking pin rotation assembly includes a plurality of connecting rods connecting each of the locking pins to a centrally positioned handle assembly whereby operation of the handle assembly simultaneously operates each of the locking pins.

12. The safety cage of claim 11 wherein the locking pin rotation handle assembly further includes a lever arm rotatably mounted about its center point, wherein a first connecting rod connects one end of said lever arm to one of the locking pins at one end of the roof support assembly, and second, third and fourth connecting rods connect said locking pin to the other locking pins located at said same end of the roof support assembly; and a fifth connecting arm connects the distal end of the said lever arm with one of said locking pins of the opposite end of the roof support assembly and a sixth, seventh and eighth connecting rod connects said locking pin to the other locking pin at said opposite end of the roof support assembly.

13. The safety cage of claim 12 further comprising a locking means for preventing the accidental operation of the handle assembly.

14. A safety cage and cargo bridle assembly for providing safety in the transportation of the safety cage comprising:

a cargo container bride;

a protective frame having a roof assembly having essentially the same configuration as the cargo container bridle, said roof support assembly including a pair of outer end members and a pair of inner end members located within said outer end members;

a pair of rotatable locking pins positioned within each of said outer end members of said roof assembly and a pair of rotatable locking pins positioned within each of said inner end members of said roof assembly;

a locking pin activation assembly mounted within said protective frame, said activation assembly being connected to each of said pairs of locking pins, said activation assembly moving said locking pins from locked to unlocked positions and from unlocked to locked positions;

first and second connector members fastened to said cargo bridle, said connector members being adapted to receive said first and second pairs of locking pin wherein the protective frame and cargo bridle are securely joined together when the locking pin are rotated to the locked position.

15. The safety cage and cargo bridle assembly of claim 14 wherein said first pair of locking pins are connected by means of a first connecting rod and said second pair of locking pins are connected by a second connecting rod.

16. The safety cage and cargo bridle of claim 14 wherein said activation assembly includes a rotatably lever member having opposed arms, a first activation rod connecting one of said lever member arms with said first pair of locking pins and a second activation rod connecting the remaining lever member arm with said second pair of locking pins; and handle means for rotating said lever member.

17. The safety cage and cargo bridle of claim 16 further comprising locking means for preventing the accidental operation of the handle means.

18. The safety cage and cargo bridle of claim 14 further comprising locking pin means in said cargo container bridle for engaging said protective frame and locking pin receiving means in said protective frame for receiving said locking pin means.

* * * * *